US007243809B2

(12) United States Patent
Bezar

(10) Patent No.: US 7,243,809 B2
(45) Date of Patent: Jul. 17, 2007

(54) GIFT WRAPPING PACKAGE AND METHOD OF USE

(76) Inventor: David Bezar, 23052H Alicia Pkwy., Suite 172, Mission Viejo, CA (US) 92692

( * ) Notice: Subject to any disclaimer, the term of this patent is extended or adjusted under 35 U.S.C. 154(b) by 25 days.

(21) Appl. No.: 11/142,150

(22) Filed: May 31, 2005

(65) Prior Publication Data

US 2006/0266008 A1 Nov. 30, 2006

(51) Int. Cl.
*A45C 7/00* (2006.01)

(52) U.S. Cl. ..... 220/9.2; 220/252; 206/457; 446/5

(58) Field of Classification Search ..... 220/4.21, 220/4.24, 4.25, 4.28, 9.2, 252, 314, 6; 383/104, 383/119; 206/457; 446/5
See application file for complete search history.

(56) References Cited

U.S. PATENT DOCUMENTS 1,691,904 A * 11/1928 Gamble ..... 206/8
5,542,560 A * 8/1996 Gerster et al. ..... 220/252
5,714,211 A * 2/1998 Zinbarg et al. ..... 428/16
6,027,437 A * 2/2000 Vercelli et al. ..... 493/85
2005/0045514 A1* 3/2005 Knotts ..... 206/457

* cited by examiner

*Primary Examiner*—David Fidei
(74) *Attorney, Agent, or Firm*—Russo & Duckworth

(57) ABSTRACT

A gift wrapping package is provided which provides enhanced ornamentation and ease of wrapping of gifts for special events. The gift wrapping package includes a flat base and a dome-like cover which forms a central cavity. The dome-like cover is retractable and expandable. In a retracted condition, gifts can be placed within the central cavity. Thereafter, the cover can be closed by expanding and rotating the cover until the dome-like structure is formed. In a preferred embodiment, the gift wrapping package includes a hook or handle for enabling a person to carry a wrapped gift or to hang the gift wrapped package upon objects such as a Christmas tree.

2 Claims, 8 Drawing Sheets

GIFT WRAPPING PACKAGE AND METHOD OF USE

BACKGROUND OF THE INVENTION

The present invention relates generally to the field of gift wrapping packages. More particularly, the present invention relates to prepared packaging for receipt of gifts.

Presenting gifts has always been a way for people to show affection, goodwill or friendship at celebratory occasions and events. During special events such as birthdays, weddings, parties, baptisms, and other social events, it has been increasingly common for attendees to bring gifts which are provided in a box, bag, receptacle or other container. Typically, it is the gift giver's goal to make his or her gift as visually appealing and highly distinctive as possible in order to enhance the anticipation as to what is contained within the packaging. To this end, stores sell wrapping paper, bows, ribbons and cards for the purpose of making the packaging interesting and festive. Various packaging is available for wrapping gifts and the packaging comes in a myriad of colors, textures, themes and patterns.

Wrapping paper is the most common manner of packaging gifts. Wrapping paper consists of two-dimensional paper covered in decorative themes and color which must be cut and shaped around a box or other package storing a gift. Tape, glue or ribbon are then used to maintain the paper in a proper placement. Thereafter, various bows or ribbons may be used to adorn the wrapping paper. Unfortunately, the gift wrapping of packages is often a time-consuming and frustrating experience. It is difficult to properly estimate or accurately cut the correct amount of wrapping paper needed. It is also difficult to tightly and neatly attach the paper to the underlying box. To avoid this time-consuming and frustrating procedure, various gift wrapping services will wrap a package with wrapping paper for a fee. However, gift wrapping services are relatively expensive and extremely time consuming.

Recently, decorative bags have become available as an alternative to the use of wrapping paper. These decorative bags are particularly helpful when time is an issue or when giving an irregularly shaped object that may not be sold in a box. Unfortunately, the giving of gifts in packages which are not hand-wrapped may convey a lack of caring or thought. This is the sentiment which is opposite to what is intended to be conveyed by giving of a gift.

There is therefore a need for gift packaging which does not present a time-consuming and frustrating experience, while at the same time provides sufficient ornamentation and themes to convey an atmosphere of caring and consideration.

Various attempts have been made to provide decorative pre-packaged containers for gifts which provide enhance decoration compared to gift bags and which do not require the time-consuming experience of wrapping paper. For example, U.S. Patent Application 2002/0195480 naming Daniels as the inventor, describes a gift bag in which various appendages are attached to the bag to create a decorative animal. Unfortunately, the traditional shape of the gift bag and the decorative animal attachments mentioned in Daniels' patent does not particularly lend itself to three-dimensional ornamentation.

Meanwhile, U.S. Pat. No. 6,422,388 naming McCahey as the inventor, describes various shaped containers having an openable lid. By pulling the handle, the container automatically closes. Unfortunately, the construction is relatively expensive and does not lend itself to three-dimensional decorations.

U.S. Pat. No. 5,836,508 describes a package which appears to be a traditional gift wrapped package using traditional wrapping paper. However, each portion of the box-like container is covered with traditional wrapping paper. When the box is closed, the package appears to have been wrapped by the gift giver. Unfortunately, this design is restricted to the relatively boring six-sided shape of a traditional box.

Thus, there is a significant need for an improved construction for wrapping presents that is convenient, expedient to use and still show that the giver cares enough to make the gift attractive and special.

There is also a significant need for a construction for wrapping presents which provides improved ornamentation and decoration.

Furthermore, it would be advantageous to provide a construction for wrapping presents that is inexpensive to manufacture.

SUMMARY OF THE INVENTION

Briefly, in accordance with the invention I provide an improved package for wrapping gifts for presentation at celebratory events such as birthdays, Christmas, anniversaries, etc. The gift wrapping package includes a flat base and a foldable cover which forms a central cavity between the base and cover.

The flat base may be constructed in various shapes. For example, the base may be circular, rectangular, oval, or any other substantially two-dimensional shape: Moreover, the flat base may be constructed in multiple pieces and constructed of various materials such as paper, cardboard, plastic or even metals.

Meanwhile, the cover is flexible and expandable from a substantially flat construction to a dome-like construction. In its retracted construction, the cover includes an expandable arcuate body portion with the body portion having first and second curved sides and first and second ends. Preferably, one of the sides, also referred to herein as edges, is affixed to the flat base by glue or other means. As the cover expands, the edge also rotates substantially 180 degrees until the cover's edges are in the same plane. As a result of the cover's arcuate construction, the expansion of the cover creates a dome-like structure forming a cavity between the cover and base.

As defined herein, the cover includes an open condition wherein the cover is retracted to allow gifts to be positioned within the gift wrapping packages central cavity. Meanwhile, the gift wrapping package's closed condition is created when the foldable cover is expanded so that the cover's edges are maintained in a single plane forming a periphery which engages the flat base. Placing the cover in a closed condition causes the foldable cover's body to obstruct the view into the gift wrapping package's central cavity.

The cover may be constructed of any of numerous flexible materials including but not limited to paper, plastic, Mylar or fabric so as to enable the cover to rotate and expand until the cover's second edge engages the flat base. For example, the cover may be constructed of fan-folded paper or the like. Alternatively, the cover may be constructed of paper or other flexible material which have structure to support itself or is reinforced by wires affixed to the cover and the flat base.

Furthermore, the folding cover may be constructed in various shapes. For example, the arcuate cover may be semi-circular forming a half-spherical construction when in a closed condition. Alternatively, the housing may be constructed with a semi-elliptical shape to create a semi-ellipsoid shape sitting on top of the flat base. In addition, in preferred embodiments the cover may include fanciful designs printed on the cover's exterior. Various decorative appendages may also be incorporated into the cover to provide still additional ornamental enhancements.

The cover may be maintained in a closed position using various known structures. For example the cover may be maintained in a closed condition using tape, glue, snaps, velcro, string ties, or other constructions which can be selected by those skilled in the art.

Moreover, various modifications could be made to the gift wrapping package and be made without departing from the spirit and scope of the invention. For example, in an alternative embodiment the cover is constructed in one or more pieces. For this embodiment, the gift wrapping package is closed by bringing both pieces of the cover together by rotating their respective ends about a longitudinal axis until their edge's engage, thereby forming an encapsulating cover and obstructed central cavity. To keep the gift from weighing on the base of the structure, a line/sack is added that allows for the weight of the gift to be held by the edges of the packing and not by the base.

In still an additional embodiment of the invention, the gift wrapping package includes an intermediate body portion which is positioned between the flat base and dome-like cover. The intermediate body portion is tubular and has a cross-section configured to engage the cover's periphery when the foldable cover is positioned in a closed condition. In a preferred embodiment, the intermediate portion is telescopic from a retracted position to an expanded position. More particularly, the intermediate portion preferably includes a plurality of folding elements allowing the intermediate portion to retract telescopically to a low profile but also expand to enlarge the central cavity.

Still additional modifications of the invention can be made. For example, the gift wrapping package may include handles for carrying the wrapped gifts. In addition, the gift wrapping package may include hooks or other hanging elements so that the wrapped package may be hung on objects, such as a Christmas tree, hearth, window dressing, etc.

It is thus an object of the present invention to provide an inexpensive, simple to use package for wrapping and giving gifts.

It is also an object of the present invention to provide a gift wrapping package which provides greater visual appeal than prior packaging.

These and others and more specific objects of the invention will be apparent to those skilled in the art from the following detailed description taken in conjunction with the drawings.

DETAILED DESCRIPTION OF THE INVENTION

While the present invention is susceptible of embodiment in various forms, as shown in the Figures and will hereinafter be described the presently preferred embodiments of the invention with the understanding that the present disclosure is to be considered as an exemplification of the invention and it is not intended to limit the invention to the specific embodiments illustrated.

Figure 2A:
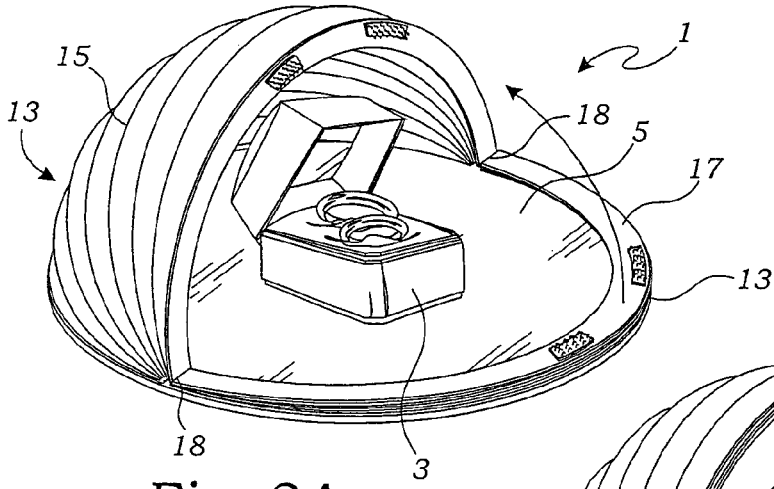
FIG. 2A is a perspective view illustrating a second embodiment of the gift wrapping package of the present invention with the housing in an open condition.
Figure 3A:
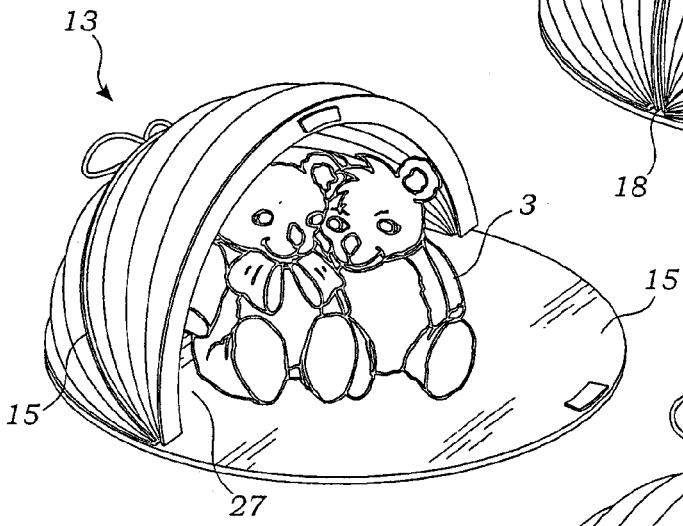
FIG. 3A is a third embodiment of the gift wrapping package of the present invention including a handle.
Figure 5:
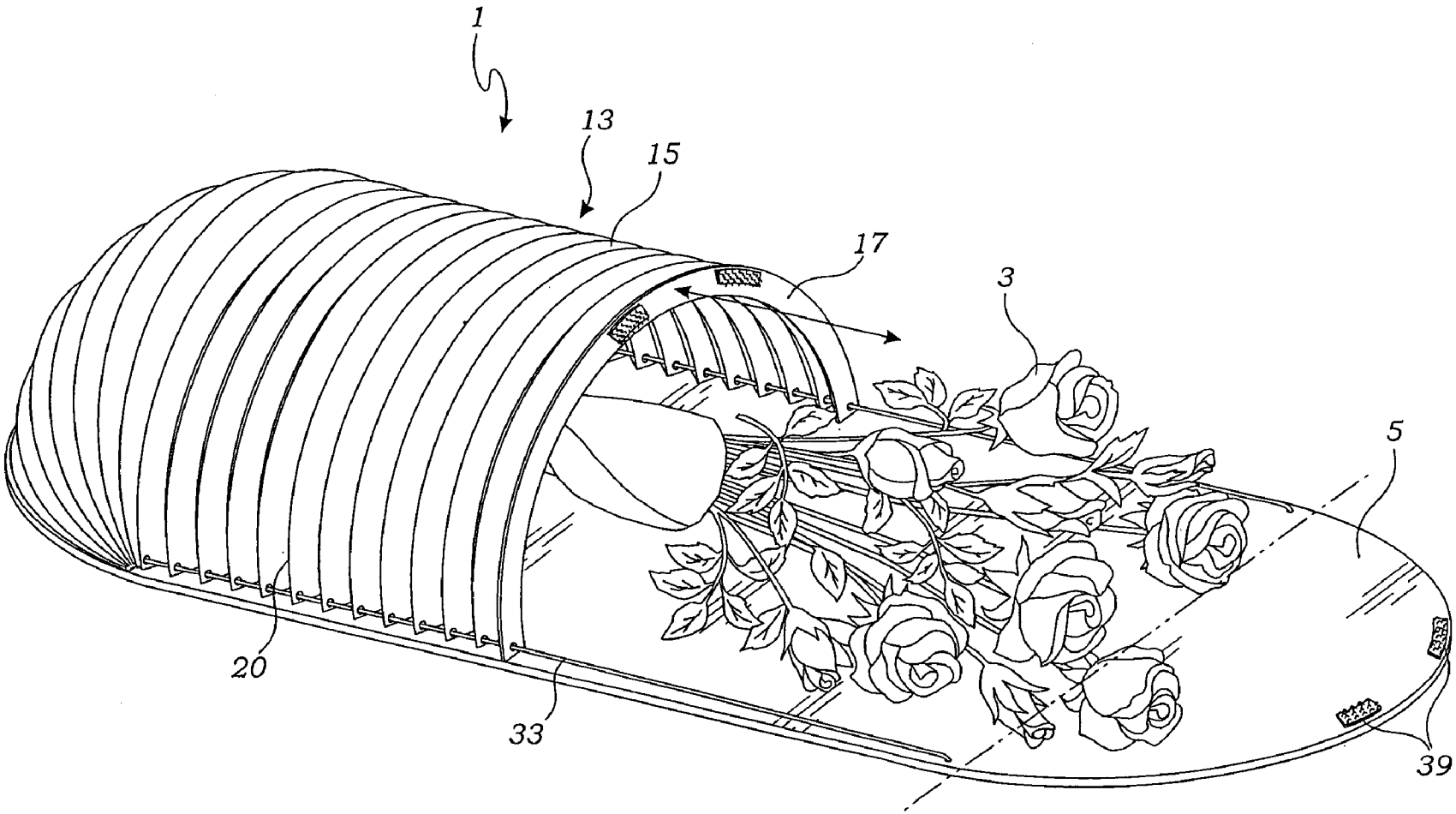
FIG. 5 is a perspective view illustrating a fifth embodiment of the present invention in which the housing is elongate and controlled by rails from an open condition to a closed condition.

With reference to the Figures, the gift wrapping package 1 of the present invention includes a flat base 5 and a cover 13. As shown in FIGS. 2A, 3A and 5, gifts 3 are positioned within the packages central cavity 27 for presentation to persons at special events.

A flat base 5 is substantially two-dimensional and can be constructed at various two-dimensional shapes. For example, in FIGS. 1–3, the base is circular. As shown in FIG. 5, the base can be constructed in an oval shape. In addition, the base can be constructed in an unlimited number of shapes to provide a fanciful appearance, a mating surface for engaging the cover 15, and a platform for supporting a gift 3. Preferably, the base is constructed of one piece of material such as paper, cardboard, plastic or another inexpensive and light material. However, as shown in FIG. 4A, the base 5 maybe constructed in multiple parts and joined together, such as by a hinge 11. Advantageously, the hinge 11 enables the base to be folded into a more compact construction for shipping and packaging.

Figure 1A:
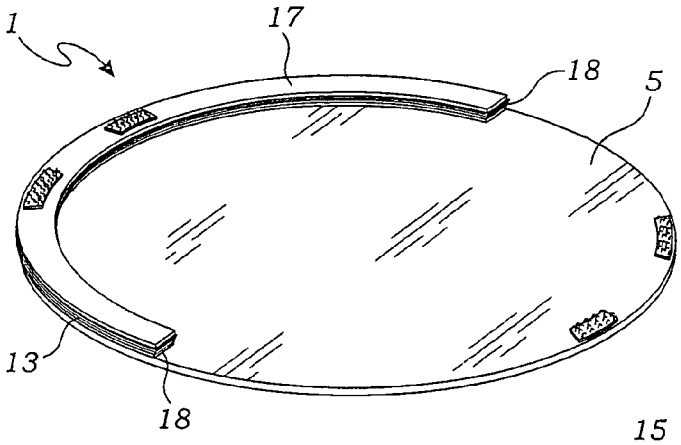
FIG. 1A is a perspective view of a first embodiment of the gift wrapping package of the present invention wherein the housing is in an open condition.
Figure 2B:
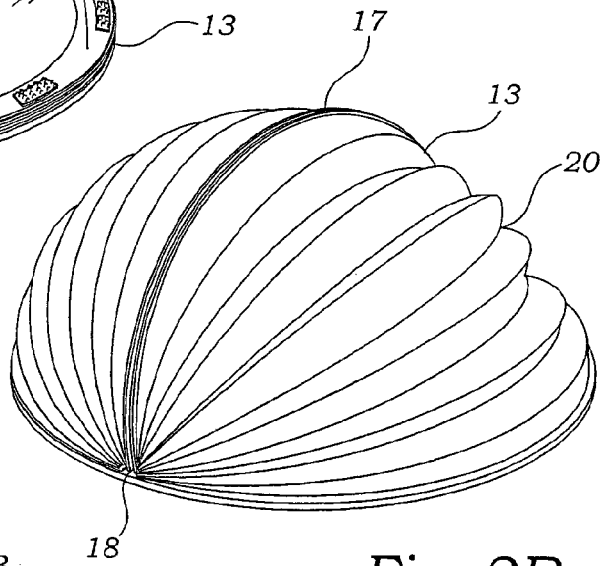
FIG. 2B is a perspective view illustrating the gift wrapping package of FIG. 2A wherein the housing is in a closed condition.
Figure 7:
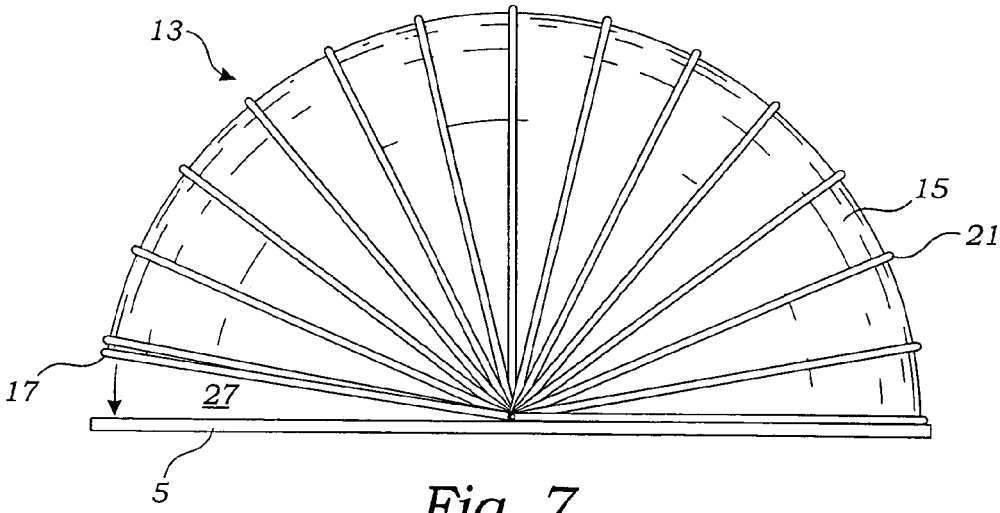
FIG. 7 is a side view of a gift wrapping package of the present invention further including wire ribs for supporting the housing.
Figure 8A:
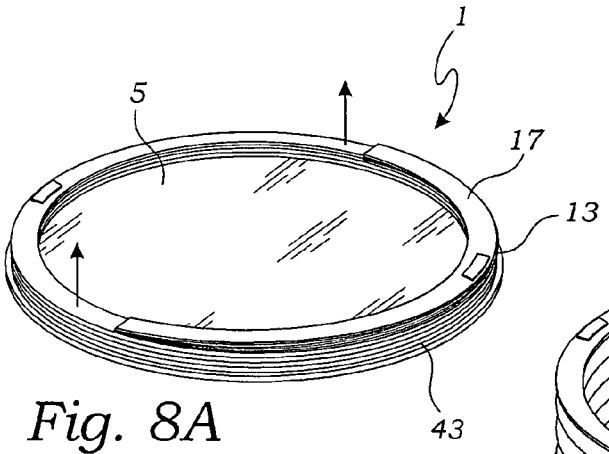
FIG. 8A is a perspective view illustrating still an additional embodiment of the gift wrapping package of the present invention including an expandable intermediate portion.

The cover 13 is an expandable and retractable structure for providing a dome-like housing over the base. As shown in FIGS. 1A, 4A and 8A, when the cover 13 is in a retracted "open" condition, the cover includes first and second arcuate edges 17 terminating at their ends 18. As the cover is expanded, the cover further includes an expanding body portion 15 shown in most of the figures. The cover maybe constructed of any flexible or expandable materials. However, in a preferred embodiment, the cover 13 is made of paper and includes a plurality of fold lines allowing the cover to expand and retract in a fan-like manner. Moreover, rigidity of the cover is important, the gift wrapping package 1 may include one or more wire ribs 21 as shown in FIG. 7 for stiffening and supporting the cover. The ribs may be positioned within the cover, outside the cover, or even formed integrally with the cover material for providing additional strength and stiffness to the gift wrapping package.

Figure 1B:
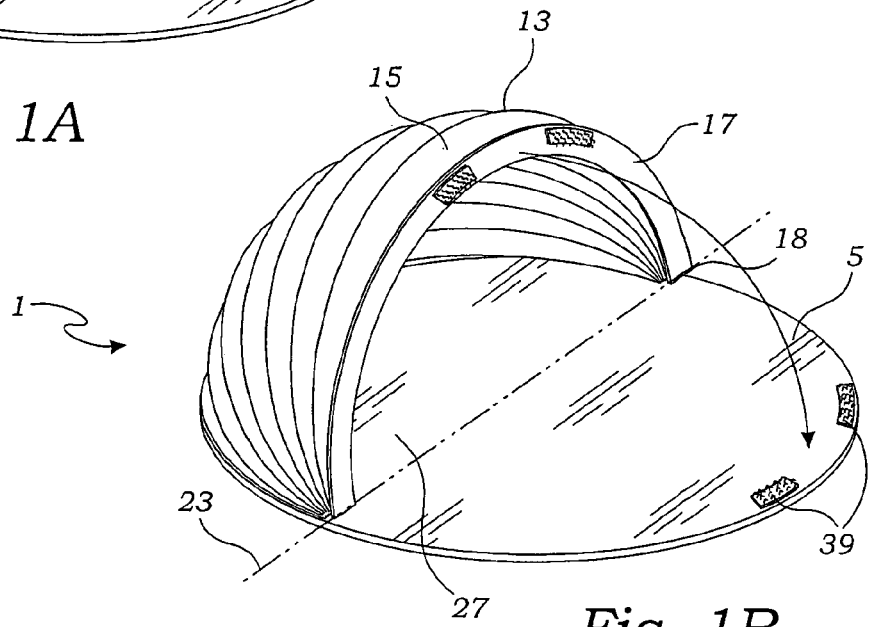
FIG. 1B is a perspective view of the gift wrapping package illustrated in FIG. 1A wherein the housing is moving to a closed condition.
Figure 1C:
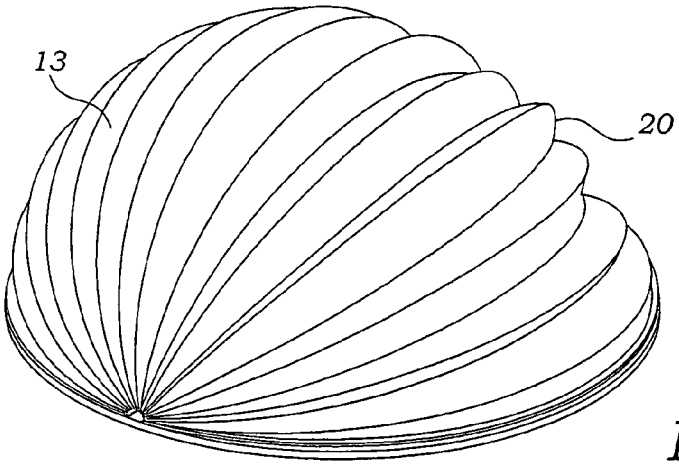
FIG. 1C is a perspective view illustrating the gift wrapping package of FIG. 1A wherein the housing is in the fully closed condition.

The cover may expand in various ways to create a dome-like structure. For example, as shown in FIGS. 1A–1C, preferred retracted cover 13 has a semi-circular cross section, thereby forming semi-circular edges 17. While expanding or retracting, the cover rotates about an axis 23 until both edges 17 of the cover engage the base 5 to form a dome having a hemispherical construction.

In an alternative embodiment of the invention, as shown in FIG. 5, the cover may rotate 180 degrees as it is expanded or contracted, as shown in FIGS. 1A–1C. However, the cover 13 also is constructed to expand laterally along the length of the base 5. This structure includes an elongate base and preferably a rail 33 which pass through holes formed in the covers body. The rails enable the cover 13 to expand laterally while maintaining engagement to the base. Shown in FIGS. 1A–1C, the cover can be constructed in one piece. Alternatively, as shown in FIGS. 2A–2B and FIGS. 4A–4B, the cover maybe constructed of multiple pieces. As shown in the Figures, in the preferred embodiment the cover is provided in a two-piece construction. Preferably, one edge of each piece is affixed to the base 5 and the opposite edges are moveable to retract or come together to engage one another to thereby close the cover 13.

The cover maybe maintained in a closed condition using various fasteners known to those skilled in the art. For example, whether the cover is a one-piece construction or multiple piece constructions, the covers can be maintained in a closed condition using tape, glue, ribbon, staple, hook and pile fasteners, etc.

Figure 3B:
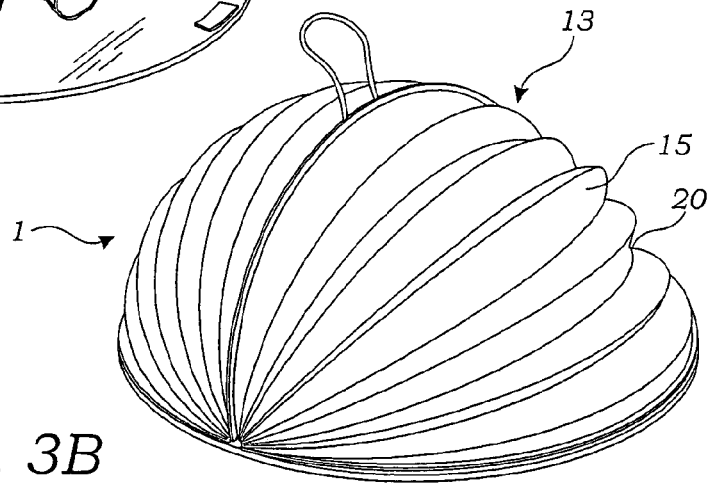
FIG. 3B is a perspective view illustrating the third embodiment of the gift wrapping package shown in FIG. 3A wherein the housing is in a closed condition.
Figure 4A:
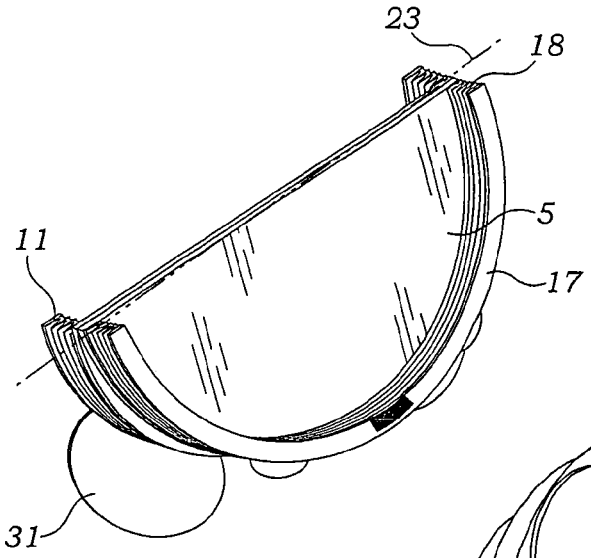
FIG. 4A is a perspective view illustrating a fourth embodiment of the gift wrapping package of the present invention wherein the housing is positioned in an open position.

Still an additional preferred embodiment of the invention, as shown in FIGS. 3A and 3B, the gift wrap package may include constructions for assisting a person to carry or hang the gift wrap being packaged. For example, the package may include a handle, loop or hook which is constructed to assist a person in carrying the package. Alternatively, the handle, loop or hook or other similar construction can be used to hang the gift wrapping package on other objects, such as upon the branches of a Christmas tree, hearth, window curtain rods, etc. As can be appreciated by those skilled in the art, the gift wrapping package thereby functions as a Christmas tree ornament for enhancing the visual appeal of the environment and increasing the appreciation of the presentation and the anticipation of the present within the package.

Figure 6A:
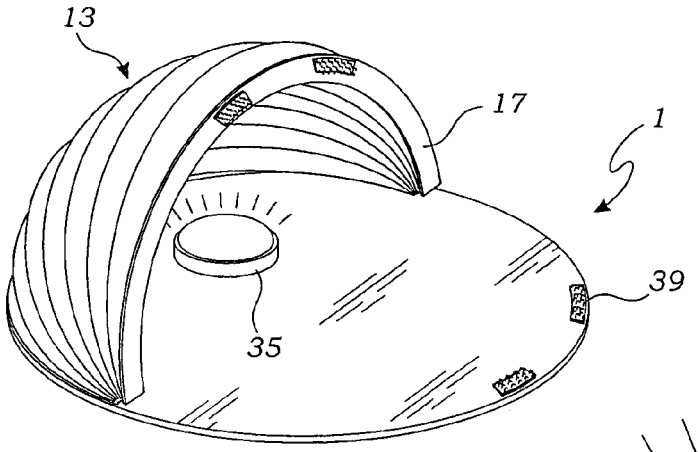
FIG. 6A is a perspective view illustrating a gift wrapping package of the present invention including an internal light source.
Figure 6B:
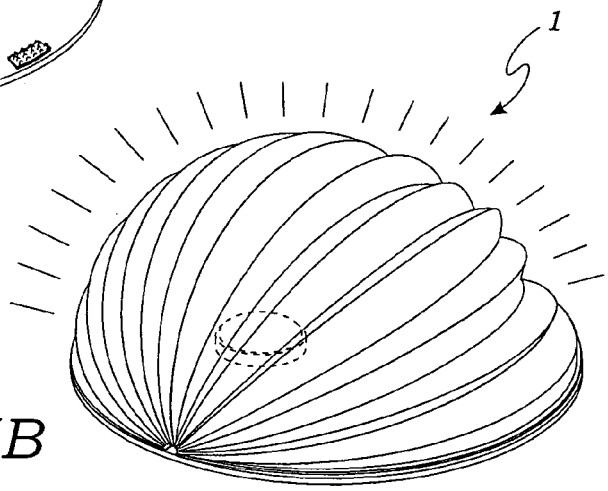
FIG. 6B is a perspective view illustrating the gift wrapping package shown in 6A wherein the housing is positioned within a closed condition.
Figure 8B:
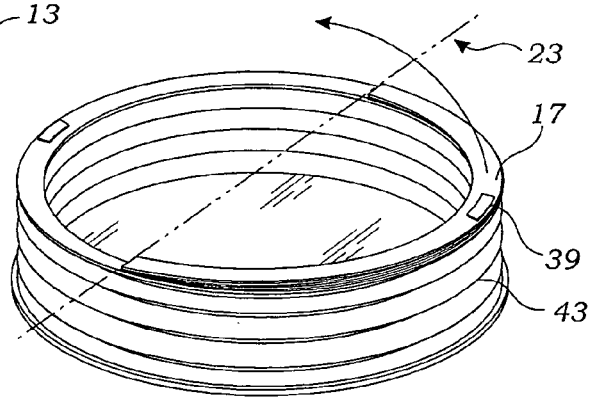
FIG. 8B is a perspective view illustrating the gift wrapping package shown in FIG. 8A wherein the intermediate portion is expanded to an annular construction.
Figure 8C:
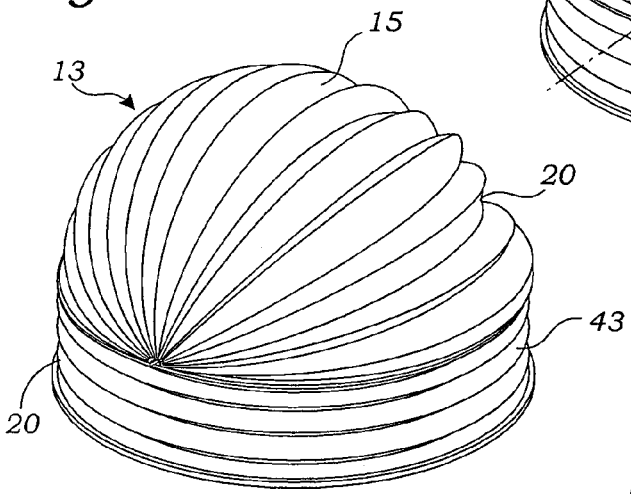
FIG. 8C is a perspective view illustrating the gift wrapping package of FIG. 8A in a closed condition.
Figure 9:
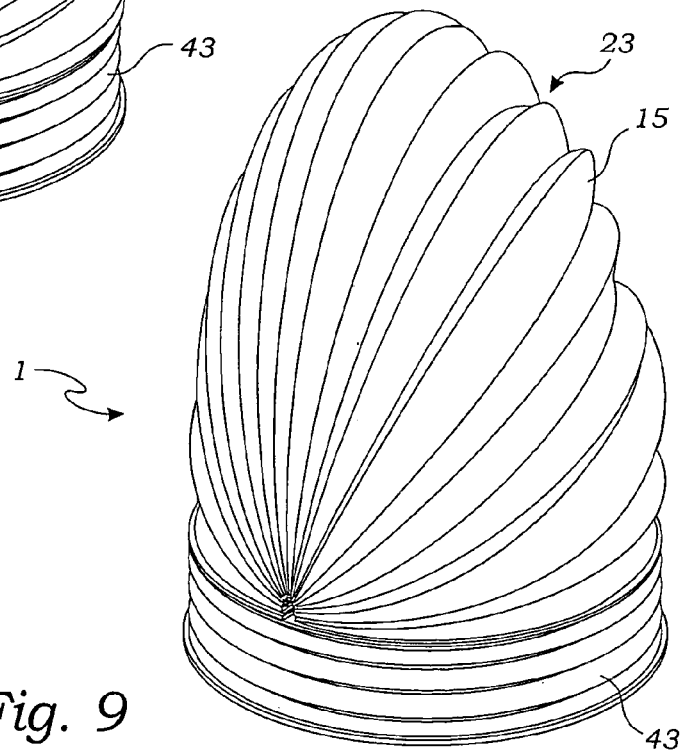
FIG. 9 is a perspective view illustrating another embodiment of the gift wrapping package of the present invention wherein the housing includes an ellipsoid shape.

In still an additional embodiment of the invention, gift wrapping package 1 includes a light 35 shown in FIGS. 6A and 6B. The light is preferably positioned within the packages central cavity 27. Since the cover 13 is preferably made of lightweight material such as paper, which are semi-translucent, the light source creates an illuminated gift wrapping package having even greater visual appeal.

Where the gift 3 is particularly large, the gift wrapping package of one of the present inventions may include an intermediate body portion 43 positioned between the base 5 and cover 13. As shown in FIGS. 8A–8C and 9, the intermediate body portion 43 is preferably tubular and expands. Like the cover, the intermediate body portion can be constructed in various ways. For example, the body portion may include a simple tubular paper construction which is supported by a single helical wire rib. The intermediate body portion can then be expanded or retracted in similar manner to a coil. Alternatively, the intermediate body portion can be constructed with fold lines 20 so that it can expand or retract in a fan-like manner. As shown in FIG. 8, in a retracted open position, the intermediate body portion is compressed to a low profile and the cover is retracted to a substantially flat arcuate condition. To form the gift wrapping package in a closed condition, the intermediate body portion 43 is expanded as shown in FIG. 8B. Thereafter, the cover 13 is closed by manually forcing the covers edge 17 upward and outward in a rotational manner around axis 23 until the edge engages the intermediate body portion 43.

Figure 10:
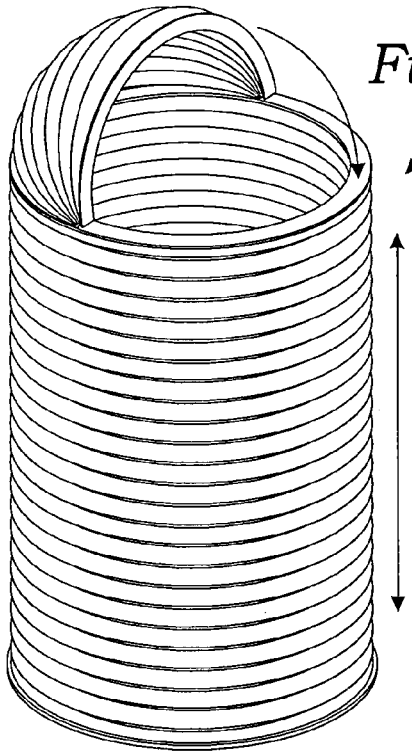
FIG. 10 is a perspective view illustrating still another embodiment of the gift wrapping package of the present invention including a circular expanding intermediate portion.
Figure 11:
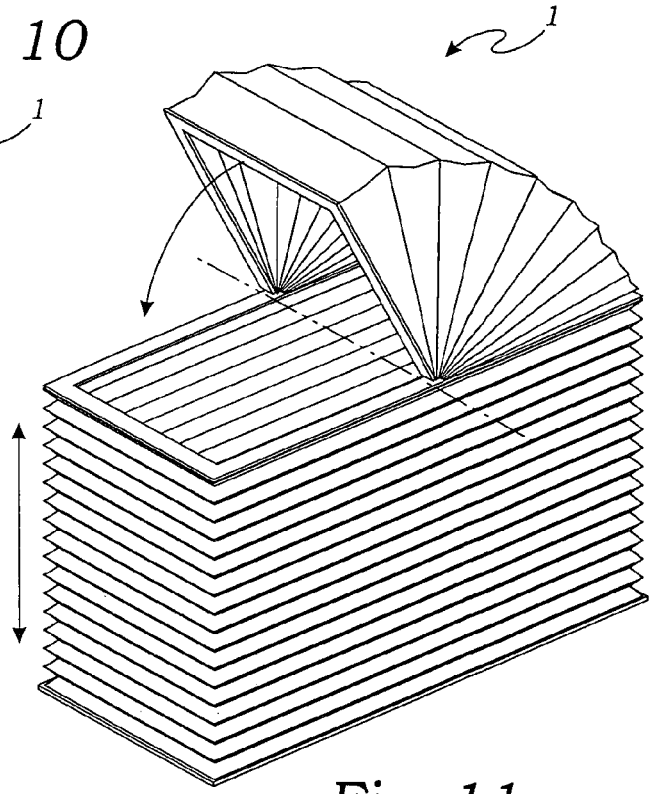
FIG. 11 is a perspective view illustrating still another embodiment of the gift wrapping package of the present invention including a rectangular expanding intermediate portion.
Figure 12:
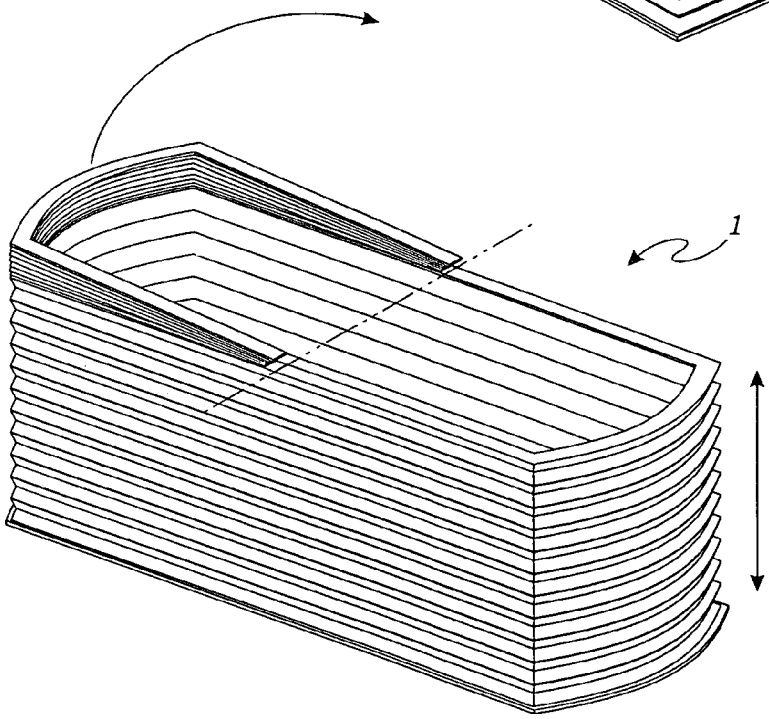
FIG. 12 is a perspective view illustrating still another embodiment of the gift wrapping package of the present invention including an expanding intermediate portion with a curved edge.

Various modifications of the gift wrapping package of the present invention can be made without departing from the spirit and scope of the invention. For example, as shown in FIGS. 10–12, the gift wrapping package including an expanding and contracting intermediate portion maybe constructed in an unlimited number of shapes and sizes. For example, the gift wrapping package of FIG. 10 including a substantially sized tubular shaped intermediate portion is particularly suited for giving wine bottles. Meanwhile, FIGS. 11 and 12 illustrate gift wrapping packing constructed for gifts having more traditional rectangular or elongate shaped presents.

Figure 4B:
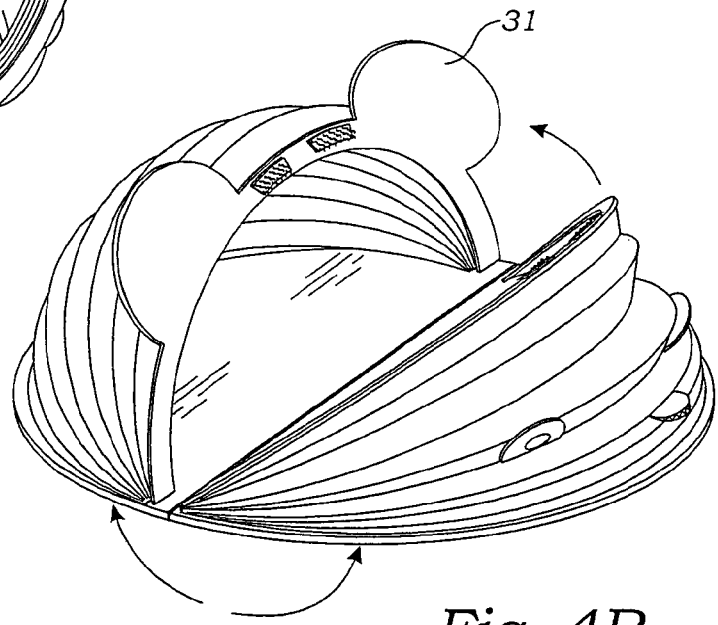
FIG. 4B is a perspective view illustrating the gift wrapping package shown in FIG. 4A wherein the housing is moving to a closed condition.
Figure 4C:
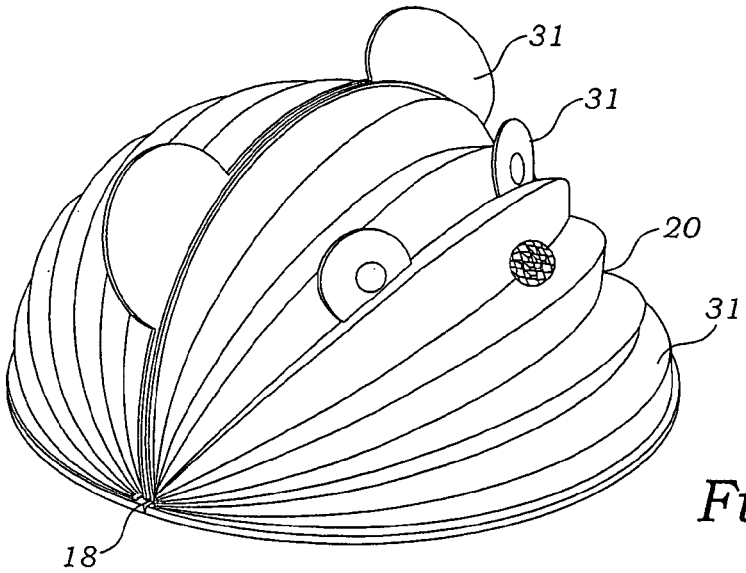
FIG. 4C is a perspective view illustrating the gift wrapping package of the present invention shown in FIG. 4A wherein the housing is positioned within a closed condition and includes various decorative elements attached to the housing to provide a fanciful appearance.
Figure 13A:
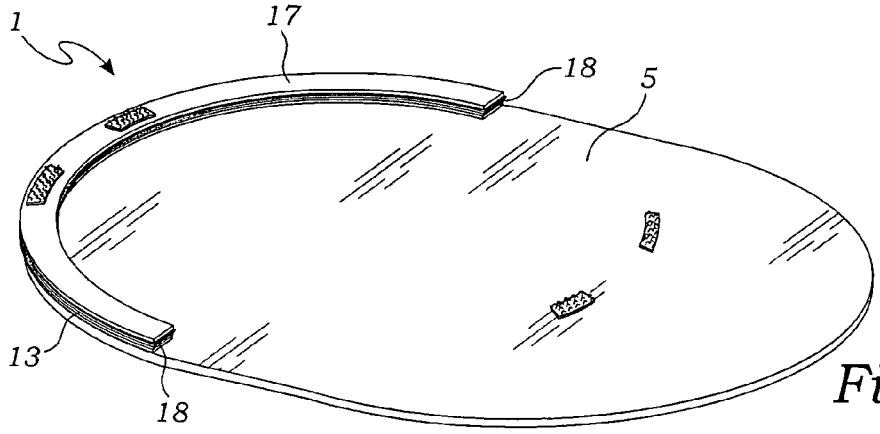
FIG. 13A is a perspective view of a first embodiment of the gift wrapping package of the present invention including an extending base wherein the housing is in an open condition.
Figure 13B:
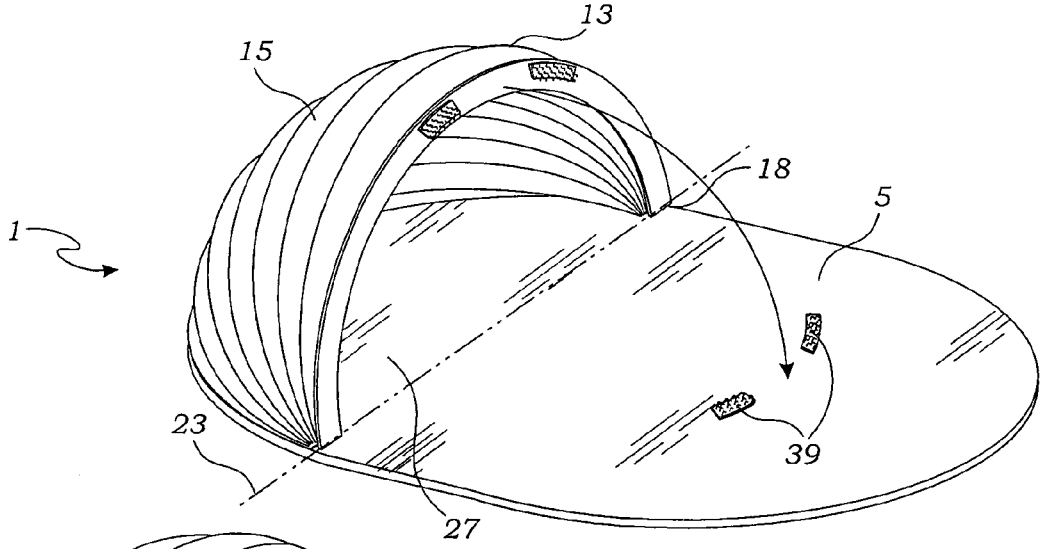
FIG. 13B is a perspective view of the gift wrapping package illustrated in FIG. 13A wherein the housing is moving to a closed condition.
Figure 13C:
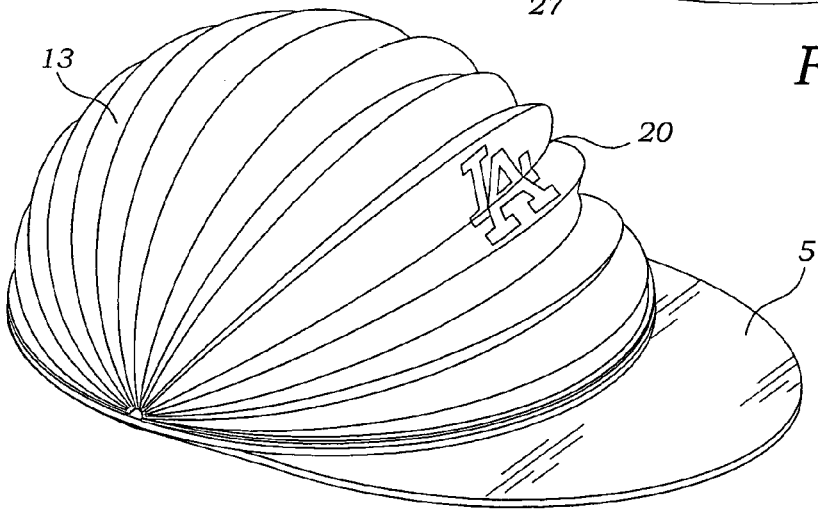
FIG. 13C is a perspective view illustrating the gift wrapping package of FIG. 13A wherein the housing is in a closed position.

The gift wrapping package may also be constructed to include various ornamental elements. For example, the package maybe adorned with various colors, symbols, or designs to provide a fanciful appearance. In addition, as shown in FIGS. 4A–4C, the cover maybe adorned with various decorative elements such as appendages 31 to form fanciful animals or other decorative constructions. Alternatively, as shown in FIGS. 13A–13B, the gift wrapping package may be constructed to include an oversized base 5. The extension of the base beyond the housing provides a place for additional ornamentation, creation of a diorama like scene or for providing messages, such as a greeting card from the gift giver. In addition, the extension of the base may act as an ornamental feature, such as shown in FIGS. 13A–13C where the base extension is constructed to resemble the bill of a baseball cap.

Although particular preferred embodiments of the invention have been described herein, it is to be understood that variations may be made in the construction, materials and shape of the gift wrapping package without departing from the spirit and scope of the invention.

Having described the invention in such terms to enable those skilled in the art to make and use it, and having identified the presently preferred embodiments thereof, I claim:

1. A method of wrapping and giving a gift package comprising the steps of:

providing a wrapping package including a flat base and an expandable housing, the expandable housing including a first arcuate edge having a first end and second end and a second arcuate edge having a first end and a second end, the first arcuate edge's first end engaging the second arcuate edge's first end and the first arcuate edge's second end engaging the second arcuate edge's second end, the housing further including a retractable and expandable body portion engaging the first arcuate edge and the second arcuate edge, the first arcuate edge and the first and second arcuate ends of both the first and second arcuate edges affixed to the flat base, the first and second arcuate ends of both the first and second arcuate edges further defining a central axis about which the second arcuate edge rotates substantially 180° relative to the first arcuate edge from a substantially flat retracted open condition to an expanded closed condition wherein the body portion expands from a retracted condition to an expanded dome-like self supporting condition to form an enclosed central cavity;

maintaining the housing within an open condition;

positioning a removable gift upon the flat base;

placing the housing within a closed condition by rotating the second arcuate edge substantially 180° relative to the first arcuate edge to position the removable gift within the central cavity;

giving the wrapped gift to a recipient at a celebratory event, and retrieving the gift by the recipient by opening the housing and removing the gift from the wrapping package's central cavity.

2. The method of wrapping and giving a wrapped gift package of claim 1 further comprising the step of securing the wrapped gift package to a holiday tree.

* * * * *